US007892402B2

(12) United States Patent
Hawes et al.

(10) Patent No.: US 7,892,402 B2
(45) Date of Patent: Feb. 22, 2011

(54) FLAT WOVEN FULL WIDTH ON-MACHINE-SEAMABLE FABRIC

(75) Inventors: John M. Hawes, Averill Park, NY (US); David S. Rougvie, Appleton, WI (US)

(73) Assignee: Albany International Corp., Albany, NY (US)

( * ) Notice: Subject to any disclaimer, the term of this patent is extended or adjusted under 35 U.S.C. 154(b) by 668 days.

(21) Appl. No.: 11/973,273

(22) Filed: Oct. 5, 2007

(65) Prior Publication Data

US 2009/0090425 A1 Apr. 9, 2009

(51) Int. Cl.

| | |
|---|---|
| ***D21F 7/08*** | (2006.01) |
| ***D21F 1/10*** | (2006.01) |
| ***D21F 7/10*** | (2006.01) |
| ***D21F 7/12*** | (2006.01) |

(52) U.S. Cl. ..... 162/358.2; 162/348; 162/900; 162/902; 162/903; 162/904

(58) Field of Classification Search ..... 162/348, 162/358.2, 900, 902–904; 139/383 A, 383 AA, 139/425 A See application file for complete search history.

(56) References Cited

U.S. PATENT DOCUMENTS

| | | | | |
|---|---|---|---|---|
| 4,006,760 | A * | 2/1977 | Romanski et al. | 139/383 A |
| 4,761,329 | A | 8/1988 | Halker et al. | |
| 4,896,702 | A * | 1/1990 | Crook | 139/383 A |
| 5,110,672 | A | 5/1992 | Zehle et al. | |
| 5,360,656 | A | 11/1994 | Rexfelt et al. | |
| 5,476,123 | A | 12/1995 | Rydin | |
| 5,531,251 | A | 7/1996 | Rydin | |
| 5,916,421 | A | 6/1999 | Yook | |
| 5,939,176 | A | 8/1999 | Yook | |
| 6,000,441 | A * | 12/1999 | Lee et al. | 139/383 AA |
| 6,117,274 | A | 9/2000 | Yook | |
| 6,283,165 | B1 | 9/2001 | Best | |
| 6,378,566 | B1 | 4/2002 | Kornett | |
| 6,508,278 | B1 | 1/2003 | Kornett | |
| 6,719,014 | B2 | 4/2004 | Kornett | |
| 6,776,878 | B2 | 8/2004 | Yook | |

FOREIGN PATENT DOCUMENTS

| | | |
|---|---|---|
| DE | 85 10 220.2 U | 6/1986 |
| DE | 10 2004 044 568 A | 3/2006 |
| WO | WO 89/12717 | 12/1989 |

OTHER PUBLICATIONS

International Search Report and Written Opinion mailed Dec. 16, 2008 by European Patent Office for corresponding international application PCT/US2008/078297.

* cited by examiner

*Primary Examiner*—Eric Hug
(74) *Attorney, Agent, or Firm*—Frommer Lawrence & Haug LLP; Ronald R. Santucci; Vivek Shankam

(57) ABSTRACT

A laminated on-machine-seamable industrial fabric made from a flat woven full width base fabric layer wherein the base fabric layer is folded inwardly and flattened to produce a fabric with seaming loops disposed at the two widthwise edges.

21 Claims, 2 Drawing Sheets

FLAT WOVEN FULL WIDTH ON-MACHINE-SEAMABLE FABRIC

BACKGROUND OF THE INVENTION

1. Field of the Invention

The invention relates to industrial fabrics in general. In particular, the invention relates to fabrics used in the forming, pressing, and drying sections of a paper making machine and a method of manufacturing the same.

2. Description of the Prior Art

Industrial fabric means an endless fabric or belt such as one used as a forming fabric, press fabric, dryer fabric or process belt ("paper machine clothing"). It can also be a belt used as an impression fabric, TAD fabric, engineered fabric, a fabric used in the production of nonwovens by processes such as melt-blowing, spun bonding, hydroentanglement or a fabric used in textile finishing processes.

In general, during the papermaking process, for example, a cellulosic fibrous web is formed by depositing a fibrous slurry, that is, an aqueous dispersion of cellulose fibers, onto a moving forming fabric in a forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention is particularly advantageous with regard to press fabrics used in the press section. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of nonwoven fibrous material. The base fabrics may be woven from monofilament, plied monofilament, multifilament or plied multifilament yarns, and may be single-layered, multi-layered or laminated. The yarns are typically extruded from any one of the synthetic polymeric resins, such as polyamide, used for this purpose by those of ordinary skill in the paper machine clothing arts.

The woven base fabrics themselves take many different forms. For example, they may be woven endless, or they may be flat woven using one or more layers of machine direction ("MD") and cross-machine direction ("CD") yarns, and subsequently rendered into endless form with a woven seam. Alternatively, they may be produced by a process commonly known as modified endless weaving, wherein the widthwise edges of the base fabric are provided with seaming loops using the MD yarns thereof. In this process, the MD yarns weave continuously back-and-forth between the widthwise edges of the fabric, at each edge turning back and forming a seaming loop. A base fabric produced in this fashion is placed into endless form during installation on a papermachine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers and therefore each fabric must typically be made to order.

In response to this need to produce press fabrics in a variety of lengths and widths more quickly and efficiently, press fabrics have been produced in recent years using a spiral winding technique disclosed in commonly assigned U.S. Pat. No. 5,360,656 to Rexfelt et al. (the '656 patent), the teachings of which are incorporated herein by reference.

The '656 patent shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip, if flat woven, is woven from lengthwise (warp) and crosswise (filling) yarns. Adjacent turns of the spirally wound fabric strip may be abutted against one another, and the spirally continuous seam so produced may be closed by sewing, stitching, melting, welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Alternatively still, the spacing between lengthwise yarns may be increased at the edges of the strip, so that, when adjoining spiral turns are arranged overlappingly, there may be an unchanged spacing between lengthwise threads in the area of the overlap.

A multiaxial press fabric may be made of two or more separate base fabrics with yarns running it at least four different directions. Whereas the standard press fabrics of the prior art have three axes: one in the machine direction (MD), one in the cross-machine direction (CD), and one in the z-direction, which is through the thickness of the fabric, a multiaxial press fabric has not only these three axes, but also has at least two more axes defined by the directions of the yarn systems in its spirally wound layer or layers. Moreover, there are multiple flow paths in the z-direction of a multiaxial press fabric. As a consequence, a multiaxial press fabric has at least five axes. Because of its multiaxial structure, a multiaxial press fabric having more than one layer exhibits superior resistance to nesting and/or to collapse in response to compression in a press nip during the papermaking process as compared to one having base fabric layers whose yarn systems are parallel to one another.

The fact that there are two separate base fabrics, on top of the other, means that the fabrics are "laminated" and each layer can be designed for a different functionality. In addition, the separate base fabrics or layers are typically joined together in a manner well known to the skilled artisan including, depending upon the application, as aforesaid the needling of batt therethrough.

As mentioned above, the topography of a press fabric contributes to the quality of the paper sheet. A planar topography provides a uniform pressing surface for contacting the paper sheet and reducing press vibrations. Accordingly, efforts have been made to create a smoother contact surface on the press fabric. But surface smoothness may be limited by the weave pattern forming the fabric. Cross-over points of interwoven yarns form knuckles on the surface of the fabric. These knuckles may be thicker in the z-direction than the remaining areas of the fabric. Consequently, the surface of the fabric may have a non-planar topography characterized with localized areas of varying thickness, or caliper variation, which may cause sheet marking during a pressing operation. Caliper variation can even have an adverse effect on a batt layer resulting in non-uniform batt wear, compression and marking.

Laminated press fabrics, specifically multiaxial fabrics, may have such caliper variation. Specifically, in the special case of a multiaxial fabric having two layers with the same weave pattern, localized caliper variation may be intensified. Therefore, a need exists for a press fabric with reduced caliper variation to improve pressure distribution and reduce sheet marking during operation.

Other forms of papermaking fabrics are disclosed in U.S. Pat. Nos. 5,916,421; 5,939,176; 6,117,274 and 6,776,878 to Yook, and U.S. Pat. Nos. 6,378,566; 6,508,278; and 6,719,014 to Kornett, whose teachings are incorporated herein by reference.

One of the purposes of the present invention is also to address some of the limitations of current seamed multi axial fabrics. Specifically, spiral winding of "narrow" strips of woven cloth, may introduce discontinuities at the interface of each strip width when forming the seam via interdigitated loops as taught in the prior art. These discontinuities include: a) missing or distorted loops at each bond, occurring along the seam, and b) migrating CD yarn ends or picks that protrude into the loop sight tunnel periodically, at a frequency depending on the angle of the spiral wind (angle between warp yarn axis of narrow cloth and machine direction of final structure). In addition, the spiral winding technique taught in the prior art starts with a structure with a dimension of W×2 L (referencing the final dimension on the paper machine). If woven, this structure of size W×2 L is comprised of the same starting material in terms of yarn density and weave pattern. It has been learned, however, that layers having the same yarn density, spacing and weave pattern create an interference or Moiré Effect or pattern in the final structure.

It should be noted that in the case of most laminated multilayer fabrics whether or not multiaxial, some characteristic interference or the Moire Effect may occur since yarn alignment between layers is not often perfect. In laminated press fabrics, those consisting of two or more base structures or layers, such fabrics exhibit the Moire Effect that is a function of the spacing and size of both MD and CD yarns. This Effect is magnified if the yarns are single monofilament yarns, especially as the diameter increases and count decreases. The Effect also exists in multiaxial fabrics since the orthogonal yarn system of one layer is not parallel or perpendicular to those of the other layers.

Multiaxial multilayer fabric structures have provided many papermaking performance benefits because of their ability to resist base fabric compaction better than conventional, endless woven laminate structures. The reason for this is that, in the case of, for example, a two-layer multiaxial laminate, orthogonal yarn systems of one layer are not parallel or perpendicular to those of the other laminated layer. However, because of this, the relative angle between the respective MD and CD yarn systems of each layer (i.e. layers 110 and 120) ranges in practicality from 1 to 7° offset. The effect of this angle is that it greatly intensifies the Moire Effect and could cause the planarity of the interfacial topography to deteriorate.

The present invention describes a fabric comprising a flat woven full width on-machine-seamable base fabric and a process of making thereof, which address the limitations associated with fabrics in the described prior art. The present invention, specifically, solves the problems associated with Moire effect, and further provides for a faster production method, which overcomes the drawbacks of endless weaving.

SUMMARY OF THE INVENTION

One object of the invention is to address some of the limitations of current seamed fabrics and to provide further advantages such as producing a stronger and more reliable fabric and a method of manufacturing thereof.

Another object of the present invention is to reduce or eliminate the Moiré Effect that can generally be seen to occur in on-machine-seamable multilayered fabrics.

Yet another object of the invention is to avoid discontinuities, including missing or distorted loops at the seam, and migrating CD yarn ends common in seamed multi-axial fabrics.

Yet another object of the invention is to improve seam loop orientation, planarity and parallelism by using a single event loop formation technique (all loops being formed simultaneously) instead of the multi-event loop formation used in current seamed modified endless woven fabrics.

Yet another object of the invention is to eliminate or provide an alternative to endless weaving, and thereby provide faster production speeds through the use of flat weaving.

The invention, specifically, is an on-machine-seamable industrial fabric made from a flat woven full width base fabric layer and the method of manufacture thereof. The flat-woven base fabric comprises a plurality of lengthwise yarns and a plurality of crosswise yarns. The base fabric layer is woven in two or more weave patterns and yarn densities for twice the length of the final fabric to be produced. At approximately one quarter and three quarters the length of the base fabric, demarcated regions, such as "skipper regions" or MD lengths without CD yarns are woven. The demarcated region can also be formed by weaving in CD yarns that can be subsequently removed from the fabric. The boundaries of the demarcated regions can be defined by weaving special CD filler yarns or textured yarns or what is sometimes referred to as Circumflex yarns. The use of Circumflex yarns is optional, but when used, they would be inserted or woven in the same manner as the rest of the fabric. The length of the skipper region is approximately twice the working length of the seaming loops used in a later interdigitating step. As described more fully referencing FIG. 1, up to the first skipper at approximately one quarter the length of the base fabric and after the second skipper at approximately three quarters the length of the base fabric, the fabric preferably has CD yarn densities and/or weave patterns that are different from that of the section between these lengths so as to address the Moire Effect. The base fabric layer is flattened to produce a fabric with the skipper region at each end. In other words, the fabric is folded in the machine direction ("MD") upon itself such that the skipper regions are 180 degrees opposite each other so that the common MD yarns form seaming loops on both widthwise edges. The fabric then can be temporarily or permanently attached together at the other abutting end, the free ends at these joints, now located in one layer of the fabric, can be left unbonded or can be bonded to one another by various methods, such as, for example, thermal welding, ultrasonic bonding or fusion.

The two layers of the final fabric can be laminated to one another by needling staple fiber batt material therethrough for use as a press fabric, for example. At least one layer of staple fiber batt material is needled into one of the fabric plies and through the other to laminate the first and second fabric plies to one another. Other means of laminating the plies together, such as use of adhesives or thermal fusion methods are readily apparent to those skilled in the art.

The fabric is joined into endless form during installation on a paper or other industrial process machine by directing a pintle through the passage formed by the interdigitation of the seaming loops at the two widthwise edges of the laminated fabric.

The result is a laminated two layer base fabric layer in the form of an endless loop having a machine direction, a cross-machine direction, an inner surface and an outer surface.

For a better understanding of the invention, its operating advantages and specific objects attained by its uses, reference is made to the accompanying descriptive matter in which preferred, but non-limiting, embodiments of the invention are illustrated.

Terms "comprising" and "comprises" in this disclosure can mean "including" and "includes" or can have the meaning commonly given to the term "comprising" or "comprises" in US Patent Law. Terms "consisting essentially of" or "consists essentially of" if used in the claims have the meaning ascribed to them in US Patent Law. Other aspects of the invention are described in or are obvious from (and within the ambit of the invention) the following disclosure.

BRIEF DESCRIPTION OF THE DRAWINGS

The accompanying drawings, which are included to provide a further understanding of the invention, are incorporated in and constitute a part of this specification. The drawings presented herein illustrate different embodiments of the invention and together with the description serve to explain the principles of the invention. In the drawings.

DETAILED DESCRIPTION OF PREFERRED EMBODIMENTS

The fabrics disclosed herein relate to industrial fabrics as aforesaid including but not limited to fabrics or paper machine clothing used in sections of a papermaking machine, e.g. forming, drying and/or press sections. However, the preferred embodiments described herein refer to a press fabric used in the press section of a papermaking machine.

According to one aspect of the invention, a full width base fabric structure of twice the length of the final fabric is woven using a combination of chosen weave patterns and/or CD yarn densities, size or yarn types. A method of manufacture of the same according to one aspect of the invention is depicted in FIGS. 1-3B, whose description is given in more detail in the following paragraphs.

On a weaving loom having a width at least equal to or greater than W (the full width of the required final fabric), a base fabric 50 is woven from a starting position 0, at a first MD and CD yarn density and/or first weave pattern of choice, yarn size and/or type, for approximately one-quarter the length (Al) of the base fabric. Any weave pattern, such as, e.g. plain, twill, and satin, and combinations thereof, or those known to one skilled in the papermaking arts can be used in weaving the base fabric. Any polymeric material such as, e.g. polyamide (PA), polyethylene terephthalate (PET), polyethylene naphthalate (PEN), polyphenylene sulfide (PPS), polybutylene terephthalate (PBT) and combinations thereof, or those known to one skilled in the art can be used for the MD and/or CD yarns herein.

At this length (0.25 L), which is approximately one quarter the length of the base fabric, a demarcated region such as a "skipper region", without CD yarns, is woven (fabric advanced in the loom a short distance) for a predetermined MD length. The demarcated or skipper region can also be formed by weaving in CD yarns that can be subsequently removed from the fabric. The boundaries of these demarcated regions can also be defined by weaving special CD filler yarns or textured yarns or what is sometimes referred to as Circumflex (See e.g., U.S. Pat. Nos. 5,476,123 and 5,531,251) or fusible yarns. Any weave pattern can be employed to add in additional CD yarns, including weaves like those taught in U.S. Pat. No. 6,378,566, the entire teachings of which are incorporated herein by reference. The length of the skipper region is approximately twice the working length of the seaming loops formed by the MD yarns used in an interdigitating step, a detailed description which is given in later part of the description.

Figures 1, 2, 3A:
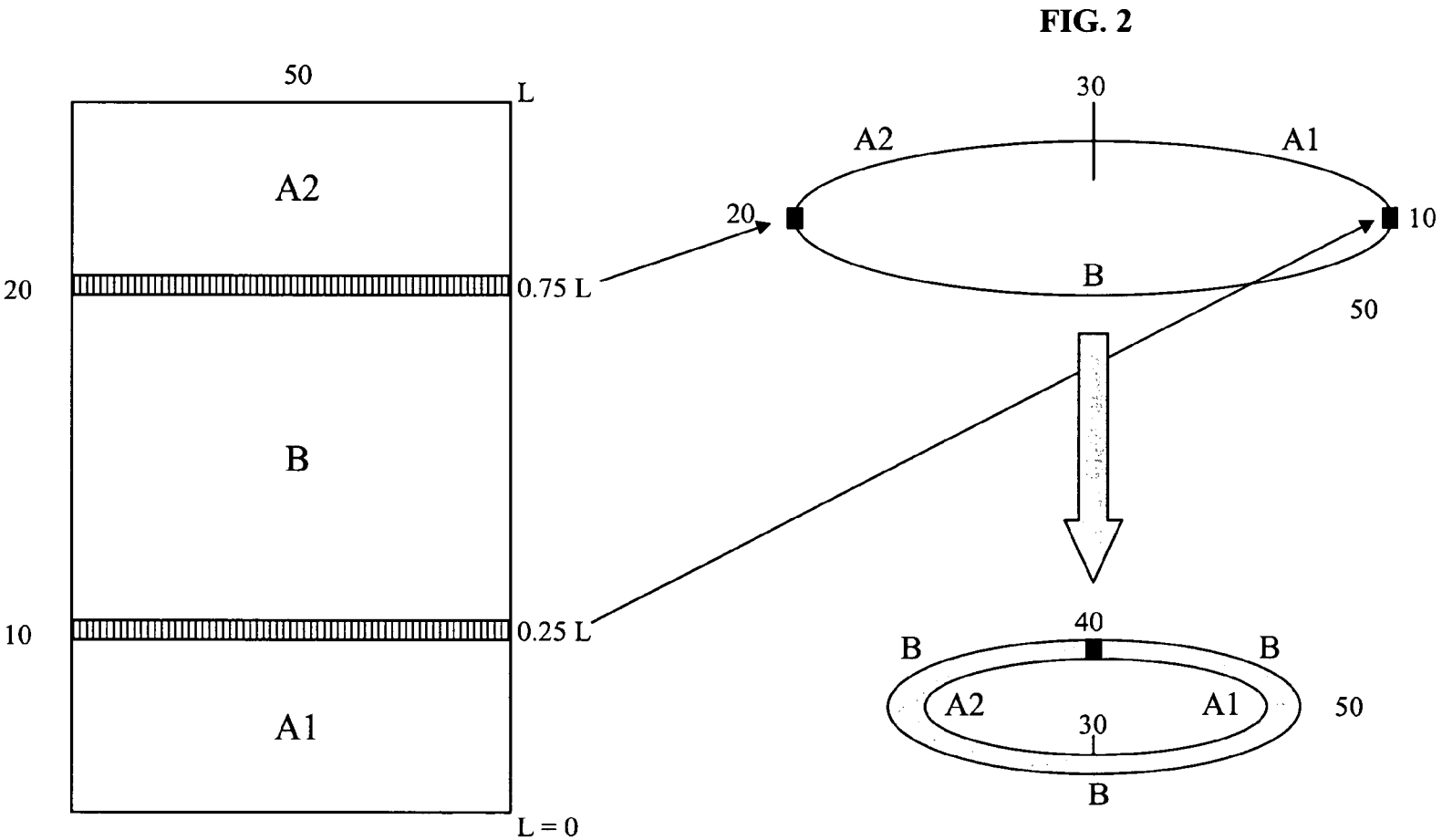
FIG. 1 shows a flat view of a fabric according to one aspect of the invention.
FIG. 2 shows a plan view of a fabric according to another aspect of the invention.
FIG. 3A shows a plan view of a fabric according to yet another aspect of the invention.

After the skipper region is created, weaving continues for a length approximately equal to 0.5 L, or one half of the length of the base fabric before loop seaming, up to a point defined as 0.75 L (B), approximately three quarters the length of the base fabric, shown in FIG. 1. At the end of section B, another skipper region (20) as described above is woven without CD yarns. This section B can be the same weave pattern and/or CD yarn density size or yarn type used in sections A1 and A2, or different therefrom and so chosen that way to avoid the Moiré Effect or interference pattern caused from laminating "like" structures, as described above, that may occur in any fabric forming process using separate base fabric layers laminated together. Also, since the "B" section would form the paper-side base layer in final form, the weave pattern and/or CD yarn density, size or yarn type choice for section B could be optimized in a manner suitable for the purpose such as pressure distribution, for example. Note that MD yarn density, size or yarn type may, however, be the same in all sections.

After creating the second skipper region (20), weaving continues for a length approximately equal to 0.25 L, or approximately one quarter length of the base fabric, with the same weave pattern, yarn density size or yarn type of section A1, until a full final length of L (which includes the amount used for the two skippers regions) is woven.

This flat woven piece of fabric 50 of dimension W×L is then folded upon itself at regions 10 and 20, and joined at positions 0 and L (30) and may be bonded or otherwise joined preferably on the inside of the fabric to form an endless loop of length 0.5 L, which is the full length of the final fabric as shown in FIG. 2. A preferred joining method according to one aspect of the invention is ultrasonic bonding of the yarns at the two free ends (0 and L). However, other methods of bonding, such as, e.g. gluing, melting, thermal welding and fusing of the yarns may also be employed for joining the abutting yarns of the fabric 50, or, the two ends may merely be left open and unbonded.

The two layers of the final fabric can then be laminated together by, for example, needling staple fiber batt material therethrough. In this regard, one or more layers of staple fiber batt material may be needled into one of the fabric plies and through the other, to laminate the first and second fabric plies together. Other means of joining the fabric plies together will be readily apparent to one skilled in the art.

The skipper regions 10 and 20 of unwoven MD yarns have now formed continuous loops on each fabric edge. Those loops are the seaming loops 40 which will be interdigitated together and one or more seaming pins or pintles passed therethrough to form a seamed continuous fabric on the paper machine as shown in FIGS. 3A and 3B.

Figure 3B:
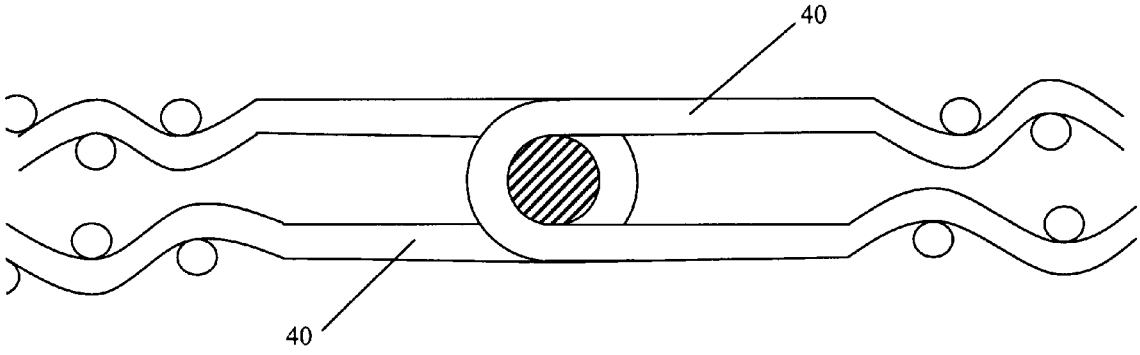
FIG. 3B shows a cross-sectional view of a fabric having seaming loops interdigitated together.

During installation on a paper machine, the seaming loops 40 formed at the two widthwise edges 10, 20 of the flattened base fabric layer 50 are interdigitated and the fabric is joined into an endless form by directing a pintle through the passage formed by the interdigitated seaming loops, as shown in FIG. 3B. Note the loop length in FIG. 3B is exaggerated for purposes of illustration.

The result is a laminated on-machine-seamable industrial fabric having a machine direction, a cross-machine direction, an inner surface and an outer surface.

Thus by the present invention, its objects and advantages are realized, and although preferred embodiments have been disclosed and described in detail herein, its scope and objects should not be limited thereby; rather its scope should be determined by that of the appended claims.

What is claimed is:

1. A method of forming a laminated on-machine-seamable industrial fabric, the method comprising the steps of:

weaving a first section of the base structure, the first section comprising machine direction (MD) and cross-machine direction (CD) yarns interwoven in a first weave pattern and/or CD yarn density, size and/or yarn type;

creating a first demarcation region, by way of a skipper or special filler yarn insert, of a predetermined length along the MD, without CD yarns;

weaving a second section of the base structure in a second weave pattern and/or CD yarn density, size and/or yarn type;

creating a second demarcation region, by way of a second skipper or special filler yarn insert, of a predetermined length along the MD, without CD yarns;

weaving a third section of the base structure in the first weave pattern and/or CD yarn density, size and/or yarn type, folding the first and third sections of the base structure such that free yarn ends of the first and third sections are adjacent to each other; and folding the fabric onto itself so as to position the demarcated regions on the widthwise edges thereof so as to form seaming loops by the MD yarns therein, wherein the first and third sections have the same weave pattern and/or CD yarn density, size and/or yarn type, which is different from that of the second section.

2. The method according to claim 1, wherein the first and third sections have the same weave pattern and/or CD yarn density, size and/or yarn type, which is same as that of the second section.

3. The method according to claim 1, further comprising the step of joining the free yarn ends of the first and third sections, thereby forming a full width laminated fabric having the full length of the final fabric.

4. The method according to claim 1, further comprising the step of interdigitating the seaming loops and inserting one or more pintles through the passage formed by the interdigitation of the seaming loops, thereby forming the industrial fabric into an on-machine-seamable fabric.

5. The method according to claim 4, wherein the MD length of the first and second demarcated regions is twice a working length of the seaming loops.

6. The method according to claim 3, wherein the joining of the free yarn ends is carried out by ultrasonic welding, gluing, melting, thermal welding, or fusion.

7. The method according to claim 1, further comprising the step of laminating the base structure by needling one or more layers of staple fiber batt material into the base structure.

8. The method according to claim 1, wherein the first, second and third weave patterns are one of plain, twill, satin and combinations thereof.

9. The method according to claim 1, wherein the MD and/or CD yarns are composed of a polymeric material selected from the group consisting of polyamide (PA), polyethylene terephthalate (PET), polyethylene naphthalate (PEN), polyphenylene sulfide (PPS), polybutylene terephthalate (PBT) and combinations thereof.

10. A laminated on-machine-seamable industrial fabric, the fabric comprising:

a flat woven base structure comprising a first section, a second section and a third section, said base structure comprising one or more sets of MD and CD yarns interwoven, said first section being woven in a first weave pattern and/or CD yarn density, size and/or yarn type;

a first demarcation region formed by way of a skipper or special filler yarn insert, without CD yarns, after the first section along the MD to a predetermined length;

said second section being woven in a second weave pattern and/or CD yarn density, size and/or yarn type, a second demarcation region formed by way of a skipper or special filler yarn insert, without CD yarns, after the second section along the MD to a predetermined length;

said third section being woven in the first weave pattern and/or CD yarn density, size and/or yarn type, wherein the first and third sections of the base structure are folded inwardly such that the free ends of the first and third sections are adjacent each other, wherein the first and third section have the same weave pattern and/or CD yarn, density, size and/or yarn type, which is different from that of the second section.

11. The fabric according to claim 10, wherein the first and third section have the same weave pattern and/or CD yarn, density, size and/or yarn type, which is same as that of the second section.

12. The fabric according to claim 10, wherein free yarn ends of the first and third sections are joined to form a full width laminated fabric having the full length of the final fabric.

13. The fabric according to claim 10, wherein seaming loops formed at the two widthwise edges of the base structure are interdigitated; and one or more pintles are inserted through a passage formed by the interdigitation of the seaming loops.

14. The fabric according to claim 13, wherein the MD length of the first and second demarcated regions is twice the length of the seaming loops.

15. The fabric according to claim 12, wherein the free yarn ends of the first and third sections are joined using ultrasonic welding, gluing, melting, thermal welding or fusion.

16. The fabric according to claim 10, further comprising one or more layers of staple fiber batt material needled into the base structure.

17. The fabric according to claim 10, wherein the first, second and third weave patterns are one of plain, twill, satin and combinations thereof.

18. The fabric according to claim 10, wherein the MD and/or CD yarns are composed of a polymeric material selected from the group consisting of polyamide (PA), polyethylene terephthalate (PET) polyethylene naphthalate (PEN), polyphenylene sulfide (PPS), polybutylene terephthalate (PBT) and combinations thereof.

19. A method of forming a laminated on-machine-seamable industrial fabric comprising the steps of:

weaving a first, second, and third section of the fabric, wherein the first and third sections have the same weave pattern and/or CD yarn density, size and/or yarn type, which is different from that of the second section; and folding the first and third sections onto the second section of the fabric.

20. The method according to claim 1, wherein the demarcation regions are formed by weaving in CD yarns that are subsequently removed from the base structure.

21. The fabric according to claim 10, wherein the demarcation regions are formed by weaving in CD yarns that are subsequently removed from the base structure.

* * * * *